US007370702B2

(12) United States Patent
Stowe

(10) Patent No.: US 7,370,702 B2
(45) Date of Patent: May 13, 2008

(54) SINGLE MILL CASING WINDOW CUTTING TOOL AND METHOD

(75) Inventor: Calvin Stowe, West University Place, TX (US)

(73) Assignee: Baker Hughes Incorporated, Houston, TX (US)

( * ) Notice: Subject to any disclaimer, the term of this patent is extended or adjusted under 35 U.S.C. 154(b) by 271 days.

(21) Appl. No.: 11/016,540

(22) Filed: Dec. 16, 2004

(65) Prior Publication Data

US 2005/0150656 A1 Jul. 14, 2005

Related U.S. Application Data

(60) Provisional application No. 60/535,553, filed on Jan. 8, 2004.

(51) Int. Cl.
*E21B 29/06* (2006.01)
*E21B 7/08* (2006.01)

(52) U.S. Cl. ..... 166/298; 166/117.5; 175/61; 175/426

(58) Field of Classification Search ..... 166/298, 166/55, 117.5, 117.6; 175/61, 80, 426
See application file for complete search history.

(56) References Cited

U.S. PATENT DOCUMENTS 2,216,963 A * 10/1940 Sinclair ..... 166/55.3
2,693,938 A * 11/1954 Roberts ..... 175/397
2,999,541 A * 9/1961 Kinzbach et al. ..... 166/55.7
5,277,251 A 1/1994 Blount et al.
5,474,126 A * 12/1995 Lynde et al. ..... 166/117.6
5,558,170 A * 9/1996 Thigpen et al. ..... 175/57
5,979,571 A 11/1999 Scott et al.
6,109,347 A 8/2000 Ferguson et al.
6,408,958 B1 6/2002 Isbell et al.
2001/0035302 A1 11/2001 Desai et al.
2002/0060073 A1* 5/2002 Dewey et al. ..... 166/298
2002/0121393 A1* 9/2002 Thigpen et al. ..... 175/431
2003/0102129 A1 6/2003 Dewey et al.

FOREIGN PATENT DOCUMENTS

EP 1 236 861 A1 9/2002

* cited by examiner

*Primary Examiner*—Jennifer H. Gay
*Assistant Examiner*—David Andrews
(74) *Attorney, Agent, or Firm*—Shawn Hunter

(57) ABSTRACT

An apparatus for cutting a window in a casing pipe in a well, having only a single mill with full gage primary cutting inserts of a very hard, highly wear resistant, material. The primary inserts can be protected from damage by forming each blade on the mill with an outside edge profile having a shallower angle than the angle of the whipstock which is used to guide the mill through the casing, preventing the primary inserts from riding directly on the whipstock. The primary inserts on each blade can be further protected from damage by a row of secondary inserts of a relatively more durable material, arranged behind each row of primary inserts, or by a full diameter buffer section of mill body or blade.

3 Claims, 2 Drawing Sheets

SINGLE MILL CASING WINDOW CUTTING TOOL AND METHOD

CROSS REFERENCE TO RELATED APPLICATIONS

This application claims the benefit of U.S. Prov. App. No. 60/535,553, filed Jan. 8, 2004, for "Single Mill Casing Window Cutting Tool".

STATEMENT REGARDING FEDERALLY SPONSORED RESEARCH OR DEVELOPMENT

Not Applicable

BACKGROUND OF THE INVENTION

1. Field of the Invention

This invention is in the field of methods and apparatus used to cut an exit or side window in a casing, downhole in a well bore, typically for the purpose of drilling a lateral well bore angled away from the main bore.

2. Background Art

Often, it is desired to cut a window in a downhole well casing in an oil or gas well, for the purpose of exiting the casing, to drill a lateral well bore off of the main bore. Typically, multiple mills are used to form such a window having the desired full gage diameter. Often, three separate mills are used, as shown in FIG. 1.

The downhole direction will be shown to the right herein, and the uphole direction to the left, but it should be understood that the borehole could be oriented vertically, horizontally, or anywhere in between. Further, it should be understood that, as used herein, the term "full gage" signifies a window having a diameter which is at least 96% of the full inside diameter of the casing which is being exited. Since the window will have an elliptical shape, the lesser or transverse diameter of such a full gage window will be at least 96% of the full inside diameter of the casing. The greater or longitudinal diameter of the window may be even greater than the inside diameter of the casing. Finally, when the term "separate mills" is used herein, it should be understood that two groups of cutting inserts separated by a substantial axial distance can be considered to constitute two "separate mills". For example, in some such mills, an axial distance of greater than one inch between groups of inserts could be considered substantial.

Often, the three mills that are typically used to cut such a window are all mounted on a work string WS together, one above the other. The lower or lead mill LM penetrates the casing wall C; then it is followed by the upper mills, commonly referred to as string mills or backup mills B1, B2. In such an apparatus, all three mills LM, B1, B2 typically have the same outer diameter, at least in their original condition. However, by the time the lead mill LM penetrates the casing C, it will usually have a slightly smaller diameter than it originally had, because of damage to the cutting inserts, resulting from severe vibration and impact against the casing C and the whipstock W. The string mills above it are then required to pass through the window in order to open it up to a substantially full gage diameter.

The lead mill LM cuts a relatively small window in the casing C as it is guided therethrough by the guide surface GS of a whipstock W. Rotation of the work string WS then continues as the second mill B1, and eventually the trailing mill B2, pass through the window, as shown in FIG. 2. Each mill slightly enlarges the window as it passes through.

Typically, at least two and often three mills must be used, because the cutting inserts on the lead mill LM and even on the second mill B1 often deteriorate rapidly, with the result that the lead mill LM and the second mill B1 lose diameter during the window cutting process. This loss in mill diameter results in the cutting of a window that is slightly smaller than the original diameter of the mills. The mills can not have an original diameter that is larger than the full casing gage, of course. So, the second and third mills B1, B2 must be used to bring the casing window diameter up to full gage.

This typical apparatus having three separate mills on the work string suffers from several disadvantages. First, it is quite costly, because three mills, or at least three spaced apart groups of cutting inserts, are required. Second, the three mills are typically mounted together in a longitudinal arrangement, with the arrays of cutting inserts on the different mills being axially separated by a distance of greater than one inch. This creates a relatively long three mill assembly with a rigid axis. As a result, the apparatus can experience a substantial amount of vibration. Third, because of the long rigid axis of the three mill assembly, it is difficult to turn the mill in a direction away from the whipstock after forming the window and exiting the casing.

BRIEF SUMMARY OF THE INVENTION

The present invention can include a method and apparatus for cutting a substantially full gage casing exit window with a single mill, rather than multiple mills. The mill of the present invention can have multiple blades, with cutting inserts mounted on the blades. The cutting inserts can be of a very hard, wear resistant, material, such as polycrystalline diamond. Although very hard, such inserts can be susceptible to damage from vibration and impact against the casing and especially against the hard guide surface of the whipstock. The original condition of the relatively hard cutting inserts can be preserved by providing a secondary set of relatively more durable inserts behind each row of the harder primary cutting inserts. These secondary inserts provided for the purpose of protecting the primary cutting inserts can be made of a relatively more durable material such as tungsten carbide.

To further counteract the susceptibility of the cutting inserts to damage, each blade can have a tapered or tapering section which tapers outwardly from its leading end toward its trailing end, with the angle of this taper being less than the angle of the wedge or guide surface on the whipstock with which the mill is used. The trailing end of the blade can be at substantially full gage diameter. A substantially full gage section of the blade above the tapered section can also be provided. A narrow band of the mill body or the blades can also be provided as a buffer section, preferably in the full gage section, with this narrow buffer section being at the full diameter of the mill body, to protect the cutters on the full gage section from shock or impact.

As the mill progresses downwardly along the whipstock, because of the difference in the blade taper angle and the whipstock wedge angle, only the nose of the mill rides along the whipstock, with the cutting inserts on the tapered and full gage sections of the blade being angled away from the whipstock. Keeping the tapered and full gage sections of the blade spaced away from the whipstock preserves the condition of the cutting inserts along the tapered and full gage sections. This causes the mill to substantially maintain its full gage diameter all the way through the casing window, thereby alleviating the need for using one or more backup mills to establish a full gage window opening.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
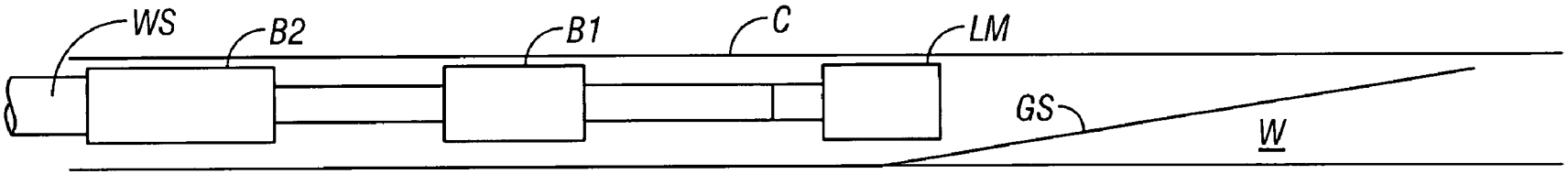
FIG. 1 (Prior Art)
FIG. 1 is a schematic view of a prior art three mill assembly.
Figure 2:
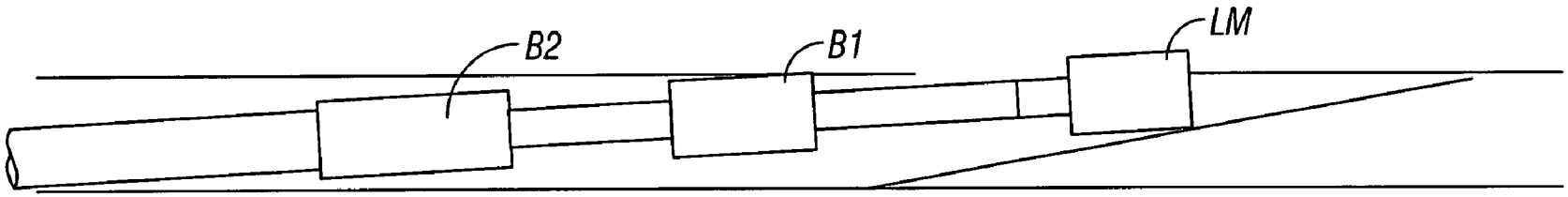
FIG. 2 (Prior Art)
FIG. 2 is a schematic view of the assembly shown in FIG. 1 as it penetrates the casing wall.
Figure 3:
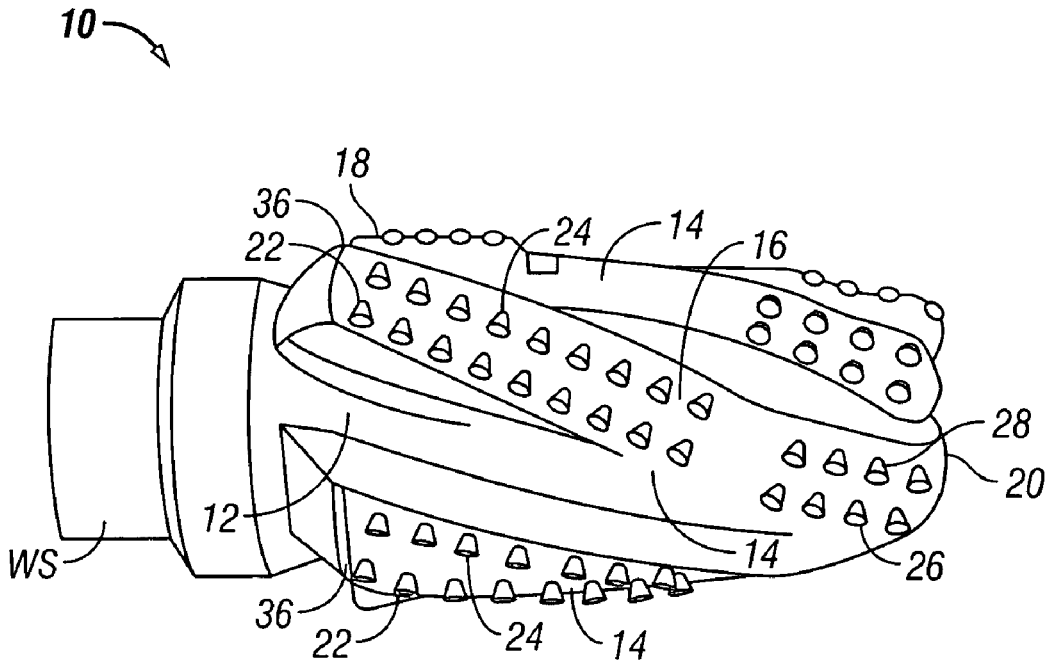
FIG. 3 is a side elevation view of the mill of the present invention.

As shown in FIG. 3, the mill 10 of the present invention includes a mill body 12, and a plurality of blades 14 spaced around the periphery of the mill body 12. The mill 10 also has a substantially rounded nose section 20, which can be formed from the leading ends of the blades 14, or which could be formed on the mill body 12 itself, without departing from the present invention. A plurality of primary cutting inserts 22 are mounted on the outer surface of each blade 14, oriented to cut through a casing as the mill 10 is rotated by the work string WS. It can be seen that the outermost edges of the primary cutting inserts 22 together establish a contour which is radially outside the outer contour of the blades 14 themselves. The primary cutting inserts 22 can be formed of a very hard material such as polycrystalline diamond, for maximum wear resistance in cutting through metal. A plurality of similar primary nose inserts 26 can be mounted on the surface of the nose section 20.

While such hard materials are optimal for wear resistance, they are often less than optimal for durability, sometimes breaking prematurely under impact against hard surfaces. To protect the primary cutting inserts 22 from impact damage, a plurality of secondary inserts 24 can also be mounted on the outer surface of each blade 14, positioned behind the plurality of primary cutting inserts 22, relative to the rotational direction of the mill 10. The rotational direction of the mill illustrated in FIG. 3 is clockwise when viewed from the uphole end. The secondary inserts 24 can be formed of a material such as tungsten carbide, which is relatively more durable than the material of the primary inserts 22. Since the secondary inserts 24 are principally for the purpose of protecting the primary cutting inserts 22 from being damaged by impact against the casing or against the whipstock, they are placed behind the primary inserts 22 in a rotational sense, leaving the primary inserts 22 exposed to rotational contact with the casing for cutting purposes. However, the secondary inserts 24 are mounted with their outermost edges lying on substantially the same contour established by the outermost edges of the primary inserts 22, thereby absorbing impacts to protect the primary inserts 22. A plurality of similar secondary nose inserts 28 can be mounted on the surface of the nose section 20, behind the primary nose inserts 26 in a rotational sense.

The blades 14 are shown as substantially elongated blades having a slightly helical shape curving around the mill body 12, but they could have other shapes without departing from the present invention. Importantly, each blade 14 has a tapered section 16 which has an outer edge that tapers outwardly from a point near its leading end 17 toward a point near its trailing end 19, as seen more easily in FIG. 4. The diameter established by all of the trailing ends 19 of these tapering sections 16 of the blades 14 can be a substantially full gage diameter, relative to the inner diameter of the casing through which the mill 10 is lowered downhole.

The outer edge of the tapering section 16 of each blade 14 lies along a contour which is at an acute angle relative to the longitudinal axis of the mill body 12. It can be seen that, since the blades shown are helical, their outer edges lie along a substantially conical contour, which can have a slight axial curve or bulge, or which can be a straight conical contour. In either case, the important feature is that the outer edge of the tapered section 16 of the blade 14 has an increased radial distance from the longitudinal axis of the mill body 12 as the blade section 16 tapers outwardly from its leading end 17 toward its trailing end 19, and that this angle of taper bears a particular relationship to the angle on the whipstock, as discussed below.

Each blade 14 also can have a substantially full gage section 18 at its trailing end, with the full gage sections 18 having outside edges which are parallel to and equidistant from the longitudinal axis of the mill body 12. That is, the full gage sections 18 of the blades 14 establish a substantially cylindrical contour which is coaxial with the longitudinal axis of the mill body 12. Each such outer edge of a full gage section 18 could be parallel to the longitudinal axis, or it could be slightly helical, without departing from the present invention. Further, the full gage section 18 could be formed on a substantially cylindrical surface of the mill body 12 itself, rather than on the blades 14, without departing from the present invention. Finally, a narrow band of the mill body 12 or blade 14 can be provided as a buffer section 36 on the full gage section 18, to act as a shock absorber, to further protect the primary cutting inserts 22 in the full gage section 18 from impact damage. The axial dimension of this narrow buffer section 36 would preferably be at least a quarter inch. The outermost diameter of this buffer section 36 would preferable be at the full diameter of the mill 10.

Figure 4:
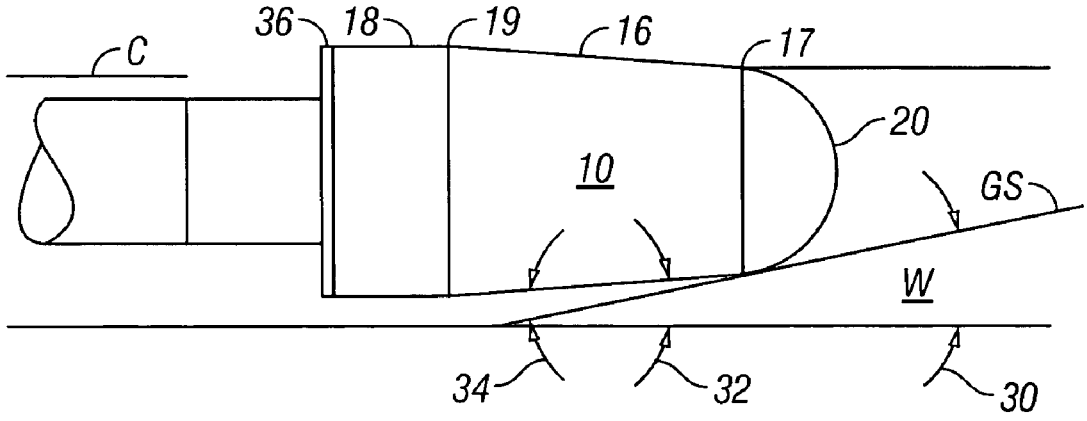
FIG. 4 is a schematic view of the mill shown in FIG. 3, as its nose moves along the whipstock and the tapered and full gage portions of the mill penetrate the casing wall.

For ease of illustration, the mill 10 is shown in FIG. 4 as having its longitudinal axis parallel to the longitudinal axis of the casing C and the longitudinal axis of the whipstock W, even though in actual use, the longitudinal axis of the mill 10 will likely be slightly angled relative to the longitudinal axis of the casing C. The upper end of the whipstock W has a wedge or angled guide surface GS, which is azimuthally oriented in the desired direction for exiting the casing C. The guide surface GS is angled at a first acute angle 30 relative to the longitudinal axis of the casing C. The tapered section 16 of each blade 14 of the mill 10 is angled at a second acute angle 32 relative to the longitudinal axis of the mill body 12. The second angle 32 is less than the first angle 30 by a third angle 34.

As the mill 10 is lowered through the casing C, the nose section 20 of the mill 10 will contact the guide surface GS of the whipstock W. The fact that the second angle 32 of the blade taper is less than the first angle 30 of the whipstock causes the outer edges of the primary cutting inserts 22 on the tapered sections 16 of the blades 14 to be angled away from the hard guide surface GS of the whipstock W. It has been found that for best effect, the magnitude of the third angle 34 should be between about 3 degrees and 10 degrees, to insure that the primary inserts 22 on the tapered sections 16 of the blades 14 will be spaced away from the whipstock guide surface GS, even when the longitudinal axis of the mill 10 is slightly angled relative to the longitudinal axis of the casing C.

As the mill 10 is rotated by the work string WS, the nose section 20 of the mill 10 moves downwardly along the guide surface GS, causing the primary and secondary inserts 22, 24 on the full gage section 18 and the primary and secondary inserts 22, 24 on the tapered blade sections 16 to contact and mill through the wall of the casing C. Only the nose section 20 of the mill 10 contacts the whipstock guide surface GS.

While this milling is taking place, it can be seen that the presence of the secondary inserts 24 and the narrow band 36 of body or blade protects the primary inserts 22 from being unduly damaged by impact against the casing C. It can also be seen that the existence of the third angle 34 keeps the primary inserts 22 from contacting the whipstock guide surface GS, thereby protecting the primary inserts 22 from undue damage. Further, the use of a single mill according to the present invention minimizes the rigid axial length of the tool and minimizes the vibration experienced, which further reduces the incidence of impact damage to the primary inserts 22. This combined protection of the primary inserts 22 allows the mill 10 to maintain the substantially full gage diameter of the outer edges of the primary inserts 22 near the trailing ends of the tapered sections 16 of the blades 14 and the substantially full gage diameter of the outer edges of the primary inserts 22 on the full gage section 18 of the mill 10. Maintaining this substantially full gage diameter allows the mill 10 to completely form a substantially full gage window in the casing wall, without the need for backup mills.

Eventually, the primary and secondary inserts 26, 28 on the nose section 20 also contact and mill through the casing C. It can be seen that the presence of the secondary nose inserts 28 protects the primary nose inserts 26 from being unduly damaged by impact against the casing C or the guide surface GS of the whipstock W.

It is to be understood that this disclosure is merely illustrative of the presently preferred embodiments of the invention and that no limitations are intended other than as described in the appended claims.

I claim:

1. A mill for cutting a window in a well casing, comprising:

a mill body adapted for mounting on a work string for rotation downhole in a well casing;

a plurality of blades formed on said mill body;

a row of primary cutting inserts mounted on each said blade;

a row of secondary inserts mounted on each said blade behind said row of primary inserts relative to the direction of rotation of said mill; and a buffer section on said mill, said buffer section having an outer diameter substantially at the full diameter of said mill, said buffer section being positioned to protect at least one of said primary cutting inserts at substantially full gage from impact damage;

wherein said primary cutting inserts are formed of a relatively harder material than said secondary inserts, and said secondary inserts are formed of a relatively more durable material than said primary inserts;

wherein said buffer section comprises a substantially full mill diameter section of said mill body.

2. A method for cutting a window in a well casing, comprising:

mounting a whipstock downhole in a well casing at a location where a casing window is to be cut, said whipstock having a guide surface at its upper end, said guide surface being formed at a first acute angle relative to the longitudinal axis of said casing;

providing a mill having a mill body and a plurality of blades formed on said mill body, with a tapering section on each said blade, said tapering section having an outside edge profile formed along a contour lying at a second acute angle relative to the longitudinal axis of said mill body, said second acute angle being less than said first acute angle;

lowering said mill into said well casing on a work string, contacting said guide surface with said nose of said mill prior to any other contact between any other portion of said mill and said whipstock, with said tapered sections of said blades angled away from said whipstock guide surface;

rotating said mill with said work string to cut a window through said casing while contacting said whipstock guide surface with said mill, and while maintaining said tapered sections of said blades angled above said whipstock guide surface.

3. The method recited in claim 2, further comprising:

providing a substantially full gage section on each said blade above said tapering section, said substantially full gage section having an outside edge profile formed along a second contour lying substantially parallel to the longitudinal axis of said mill body; and continuing to rotate said mill with said work string as said substantially full gage section passes through said window, thereby creating a substantially full gage window with said mill.

* * * * *